United States Patent [19]

Spielvogel et al.

[11] 4,433,612

[45] Feb. 28, 1984

[54] SAFETY CONTROL DEVICE FOR PROTECTING HYDRAULICALLY HELD LOADS AGAINST UNCONTROLLED PRESSURE OVERLOADING

[75] Inventors: Harry Spielvogel, Dusseldorf; Heinz Schedler, Heidesheim, both of Fed. Rep. of Germany

[73] Assignee: SMS Schloemann-Siemag Aktiengesellschaft, Dusseldorf, Fed. Rep. of Germany

[21] Appl. No.: 238,438

[22] Filed: Feb. 26, 1981

[30] Foreign Application Priority Data

Mar. 4, 1980 [DE] Fed. Rep. of Germany ..... 3008130

[51] Int. Cl.[3] ..... B30B 9/32; F15B 11/16; F15B 13/06

[52] U.S. Cl. ..... 91/514; 91/517; 91/518

[58] Field of Search ..... 91/511, 512, 514, 515, 91/517, 518, 446, 420, 445, 452, 513, 523; 92/146; 100/269 R; 60/431, 432, 484, 459, 460, 461

[56] References Cited

U.S. PATENT DOCUMENTS

| | | | |
|---|---|---|---|
| 2,526,646 | 10/1950 | Ericson | 60/484 |
| 2,611,246 | 9/1952 | Ackerman | 60/431 |
| 3,333,413 | 8/1967 | Mercier et al. | 91/523 |
| 3,824,896 | 7/1974 | Tull | 91/512 |
| 3,850,323 | 11/1974 | Ekstrom | 91/518 |
| 3,888,168 | 6/1975 | Kent et al. | 100/269 R |
| 3,942,432 | 3/1976 | Cantine, Jr. et al. | 100/269 R |
| 4,028,997 | 6/1977 | Lang | 91/518 |

*Primary Examiner*—Robert E. Garrett
*Attorney, Agent, or Firm*—Holman & Stern

[57] ABSTRACT

A hydraulic press has lowering and lifting cylinders, a controlled pressure-limiting valve connected to the high-pressure hydraulic supply, and a shuttle valve with its operating inlets connected respectively to the hydraulic supply and to the lifting cylinders and its outlet connected to the pressure-limiting valve to control it. Further valves responsive to a disturbance of hydraulic equilibrium in the hydraulic circuit operate switches controlling the hydraulic fluid supply.

12 Claims, 2 Drawing Figures

SAFETY CONTROL DEVICE FOR PROTECTING HYDRAULICALLY HELD LOADS AGAINST UNCONTROLLED PRESSURE OVERLOADING

This invention relates to copending application Ser. No. 226,737, filed Jan. 21, 1981, assigned to the same assignee.

BACKGROUND OF THE INVENTION

Field of the Invention

The invention relates to a safety control system for protecting hydraulically held loads against uncontrolled pressure over-loading, for example, in hydraulic cylinders of vertical presses or like load holding devices.

The press ram of a vertical press is commonly hydraulically returned to its top starting position by means of retraction cylinders after the press stroke is completed. For safety reasons, these retraction cylinders, in which slide pistons or plungers which are connected via tie rods to the ram, are provided with openable non-return valves which are adapted to close instantly in the event of failure of breakage of the working pressure duct by way of which the retraction cylinders are pressurised, so that the load of the ram is held and it is possible to avoid endangering personnel or destroying the press.

On the other hand, the retraction cylinder or cylinders must be open to the fluid discharge or tank during the descent of the main press piston connected to the ram, i.e., the controlled non-return valves which are disposed on the retraction cylinder must be opened by control pressure so that the hydraulic fluid in the retraction cylinder can be discharged therefrom by the descending piston. If the controlled non-return valves do not open there is a risk of bursting of the cylinders. During the press stroke the pump applies fluid pressure to the main press cylinder whose piston surface area can amount to approximately six times the piston surface area of the retraction piston. In the non-return valves do not open, the pressure applied to the piston surfaces of the retraction pistons will be six times that of the main press piston. The pistons however cannot yield. Destruction of the cylinders with all the attendant risks for the personnel would be the consequence.

BRIEF SUMMARY OF THE INVENTION

It is therefore the object of the invention to provide a safety control system for protection against uncontrolled pressure over-loading, which will in every case avoid excess pressure arising, even in the event of failure of the control pressure ducts to the controlled non-return valves, or for any other reasons of damage.

According to the invention this is achieved by a pressure limiting valve, communicating with the pressure chamber or delivery duct of a high-pressure drive, being pressure-biased on demand by the action of an associated changeover non-return valve, alternately and oppositely from pressure chambers or control ducts, protected by non-return valves, of the holding or retraction cylinder or cylinders, and from the pressure chamber of a working or descent cylinder.

This arrangement, with the additional control ducts which extend from the holding or retraction cylinders via the change-over non-return valve to the pressure limiting valve, therefore ensures that any excess pressure which may occur in the holding or retraction cylinders will not rise further. Any possible damage to the retraction or holding cylinders due to pressure transmission from the main press cylinder to the retraction cylinders is thus avoided in every case. The changeover non-return valve permits the pressure in the retraction cylinders or the pump pressure in the main press cylinder to be protected in accordance with requirements.

In another aspect of the invention, directly or indirectly pressure difference actuated valves, adapted to respond to a disturbed hydraulic equilibrium, and cooperating with limit switches which act on the operating pressure source in the event of disturbed equilibrium, are disposed between the holding cylinder or cylinders for the load on the one hand and an operating pressure source on the other hand.

Conveniently, the indirectly pressure-difference actuated valves, operating as controlled non-return valves on the holding cylinders or retraction cylinders of the press, are associated with limit switches which monitor the closed position of said valves. Limit switches are also associated with a directly pressure-difference actuated directional valve, functioning as control valve, to monitor the limiting position.

The limit switches, which monitor the closed position of the controlled non-return valves, make contact or establish an electric connection to the working pressure source when the non-return valves are opened by control pressure with the consequence that the working pressure source delivers into the main press cylinder. The contact established by the limit switch with the working pressure source is interrupted if the control pressure for opening the non-return valves drops. This can achieve interruption of the delivery flow of the pump and the pump or its electric drive is shut down or the pump is switched to unpressurized circulation. The limit switches which monitor the limiting position of the directly pressure-difference actuated directional or control valve are also electrically connected, for example to the prime mover of the pump, and interrupt the contact to the prime mover of the pump or to the pump itself with the above-mentioned consequence if the valve equilibrium position is disturbed due to the presence of a pressure difference.

BRIEF DESCRIPTION OF THE DRAWINGS

One embodiment of the invention as applied to a vertical forming press will be explained by reference to the accompanying drawings in which.

DETAILED DESCRIPTION

Figure 1:
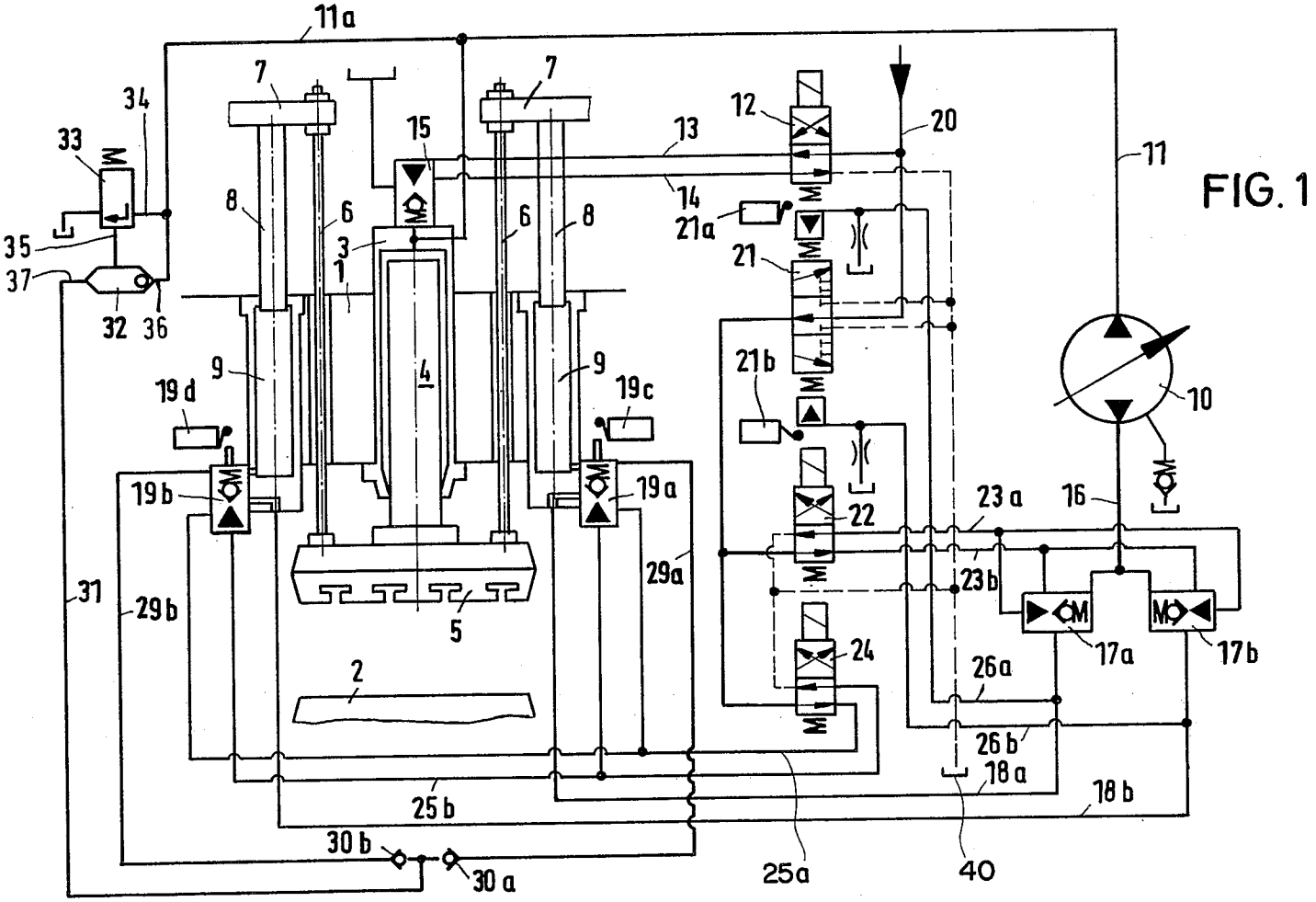
FIG. 1 is a schematic elevational view of part of a vertical forming press and a circuit diagram for controlling the return strokes of the press with a directly hydraulically controlled directional valve.

In FIG. 1, a top cylinder member 1 of a vertical forming press is connected via tie elements, not shown, to the bottom member, also not shown, and to a press table 2 disposed thereon. The bottom end of a press piston or press plunger 4 adapted to slide in the cylinder member 1 of the main press cylinder 3, is connected to a ram 5 which supports the top part of a press tool, not shown.

The ram 5 is attached to retraction rods 6 which extend vertically upwardly and are guided by the cylinder member 1. At their top ends, the two retraction rods 6 are screw mounted to cross members 7 which are connected to two retraction plungers 8 extending parallel with the retraction rods 6. The latter depend into retraction cylinders 9 which are disposed in the cylinder member 1.

The main drive for the press plunger 4 is supplied by a variable hydraulic pump 10 via working pressure ducts 11. When the press plunger 4 is retracted, a controlled non-return valve 15, disposed on the main press cylinder 3, is opened via a solenoid valve 12 and the ducts 13, 14, so that the hydraulic fluid in the main press cylinder is able to discharge into an unpressurized fluid tank.

To retract the ram 5 into its starting position, the retraction cylinders 9 are charged with hydraulic fluid at working pressure generated by the hydraulic pump 10, via a duct 16, two controlled non-return valves 17*a*, 17*b* and two further working pressure ducts 18*a*, 18*b*. The working pressure is also transmitted to two additional controlled non-return valves 19*a*, 19*b* which are disposed on the retraction cylinders 9.

To raise or retract the ram 5 into its starting position, the two controlled non-return valves 17*a*, 17*b*, which are disposed downstream of the hydraulic pump 10 in the direction of the working pressure flow, are opened or biased by a control pressure which is transmitted via the duct 20, a 4/3 directional valve 21, held hydraulically in the middle position, an electrically controlled 4/2 directional valve 22 and—as soon as the 4/2 directional valve 22 is electrically switched—a control duct 23*a* to the non-return valves 17*a*, 17*d*. With the 4/2 directional valve 22 in the normal position, control pressure is transmitted from this valve via the control duct 23*b* to the non-return valves 17*a*, 17*b* and holds the latter closed as shown in the drawings.

Normally, the 4/3 directional valve 21 is held in the middle position by means of hydraulically controlled pilot valves 21*a*, 21*b* disposed on both ends of said directional valve. From the working pressure ducts 18*a*, 18*b*, disposed between the controlled non-return valves 17*a*, 17*b* and 19*a*, 19*b*, there extend respective branch ducts 26*a*, 26*b* to the pilot valves of the 4/3 directional valve 21.

To retract the ram 5 into its starting position the 4/2 directional valve 22 must initially be electrically actuated so that the control pressure is transmitted by the duct 23*a* to the controlled non-return valves 17*a*, 17*b* and opens these to transmit the working pressure from the hydraulic pump 10 via ducts 18*a*, 18*b* to the retraction cylinders 9 of the press. Should a breakage or leakage occur in the working pressure duct 18*a* (for example) during the retraction operation, the working pressure, which prevails in the branch duct 26*a* and acts on one pilot valve of the 4/3 directional valve 21, will also drop. Accordingly, the 4/3 directional valve 21 will be unbalanced owing to the pressure difference between the two branch ducts 26*a* and 26*b*. The higher pressure in the branch duct 26*b* will then drive the directional valve 21 and hydraulically shut off the control pressure and connect the control duct 23*a* to the tank schematically illustrated at 40 through the ducts shown in dash lines.

Owing to the absence of control pressure in the controlled non-return valves 17*a*, 17*b*, which were held open, these are now closed and the transmission of working pressure to the working pressure ducts 18*a* and 18*b* is shut off. Since the non-return valves 19*a* and 19*b* on the retraction cylinders 9 are not biased by control pressure during the retraction stroke, these valves close automatically in the absence of operating pressure, so that the load, in this case comprising the ram 5 with the main press plunger 4, retraction rods 6, cross-members 7 and retraction pistons 8, will be held in the position assumed at the time of the breakage in the working pressure duct 18*a*.

Figure 2:
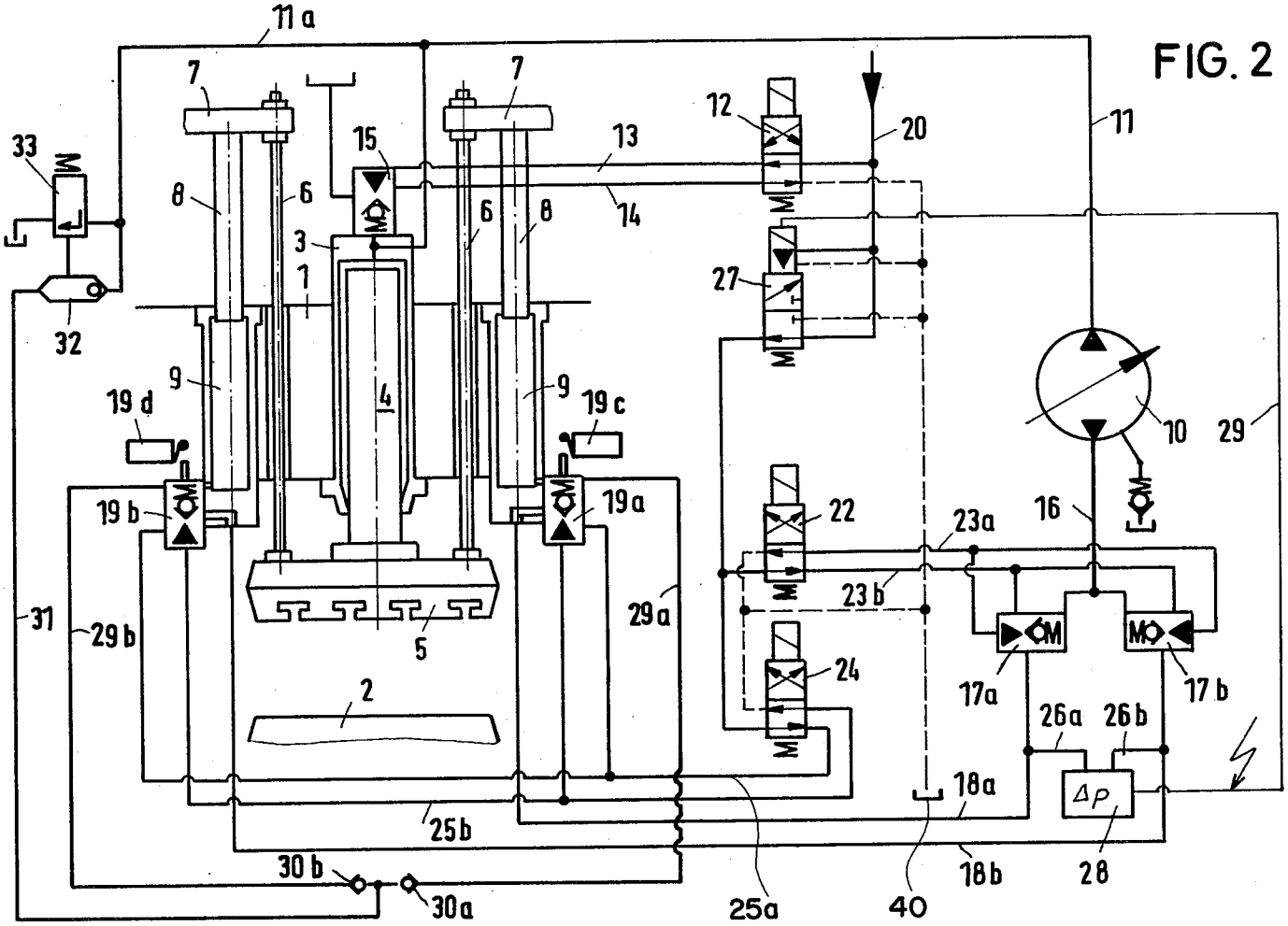
FIG. 2 is a view similar to FIG. 1 but with an electro-hydraulically controlled directional valve which is controlled via a pressure difference sensor.

FIG. 2 shows the same press as that of FIG. 1. The principle of the control circuit is also the same as that of FIG. 1. However, the 4/3 directional valve 21 shown in FIG. 1 is replaced in FIG. 2 by a 3/2 directional valve 27, which is electrohydraulically controlled, that is to say, a magnetic pilot valve hydraulically controls the 3/2 directional valve 27 which is held by spring pressure in its basic position.

Furthermore, in FIG. 2 a branch line extends from each of the working pressure ducts 18*a* and 18*b* directly to a pressure difference sensor 28. If a pressure difference occurs between the two branch ducts 26*a* and 26*b* or between the working pressure ducts 18*a* and 18*b*, the pressure difference sensor 28 will actuate the magnetic pilot valve or the 3/2 directional valve 27 via an electric conductor 29 so that the 3/2 directional valve 27 shuts off the control pressure fed via the directional valves 22 and 24 to the controlled non-return valves 17*a*, 17*b* and 19*a*, 19*b*.

In the same way as in the arrangement illustrated in FIG. 1, sudden dropping of the load in the event of breakage of one of the working ducts 18*a* or 18*b* is avoided, as well as an unobstructed discharge or working pressure fluid, which could lead to accidents and environmental pollution.

When the ram 5 is to be lowered, control pressure from source 20 through valve 21 and duct 25*b* is applied to the valves 19*a*, 19*b* by way of the 4/2 directional valve 24 which is electrically actuated into the alternate position, thereby opening the controlled non-return valves 19*a*, 19*b* to allow the working fluid to be discharged from the cylinders 9 as the retraction plungers 8 descend under the action of the main cylinder 3. The discharged fluid is normally returned to the pump. Should the discharge flow be blocked, for example by one of the valves 19*a*, 19*b* being closed, the pressure in the affected cylinder 9 will rapidly rise and may reach a dangerous level because the area of the main ram piston or plunger 4 is much greater than the area of the plungers 8, as already mentioned. An object of the present invention is to provide protection against such a dangerous pressure rise in the cylinders 9. This protection is obtained by the inclusion in the hydaulic system of a controlled pressure relief valve 33 of which the fluid flow inlet 34 is connected by a duct 11*a* to the main working pressure supply duct 11 of the main press cylinder 3. The pressure relief valve 33 has a control pressure inlet 35 which is connected to the common outlet of a changeover non-return valve or shuttle valve 32. The latter has a first inlet 36 connected to the duct 11*a* carrying the main working pressure, and a second inlet 37 connected to a duct 31. A respective control pressure duct 29*a*, 29*b* extends from each cylinder 9, via valves 19*a*, 19*b* to the inlet side of a respective non-return valve 30*a*, 30*b*. The outlets of the latter valves are connected in a T configuration to the common duct 31. These non-return valves 30*a*, 30*b* therefore permit communication of pressure from either cylinder 9 to the valve 32 while preventing inter-communication of such pressure from one cylinder 9 to another.

During operation of the main cylinder 3, the pressure relief valve 33 can provide over-pressure protection for the cylinder 3. However this relief valve also protects the cylinders 9 as will now be explained.

Because of the shuttle valve 32, the controlling pressure applied to the presure relief valve 33 will be the greater of the pressure in the main cylinder 3 and the pressure in the cylinders 9. If the pressure in a cylinder 9 rises excessively during lowering of the press, this pressure, by way of the shuttle valve 32, will take over control of the pressure relief valve 33 and, when the pressure reaches the pressure setting of the pressure relief valve, the latter will open and relieve the pressure in the working cylinder 3, so that further descent of the press ram ceases and the pressure in the cylinder or cylinders 9 will rise no further. This eliminates the risk of damage to the cylinder or cylinders 9 and the rest of the hydraulic system.

The non-return valves 30*a*, 30*b* prevent the press from adopting a skew position.

For further protection against overloading, limit switches 19*c* and 19*d* are provided on the controlled non-return valves 19*a*, 19*b* respectively. These switches monitor the positions of the associated valves and control the pump 10 accordingly. Specifically, when the press ram is to be lowered, the valves 19*a*, 19*b* are opened and their opening movement causes the switches 19*c*, 19*d* to transmit control signals such that the pump 10, which is already running idly, now delivers pressure fluid to the main press cylinder 3. This ensures that the supply of working pressure to the main cylinder will not take place unless the valves 19*a*, 19*b* are open so that the retraction plungers 8 can descend. The switches prevent the pump 10 from discharging overpressure fluid through the relief valve 33 for a long time when a controlled non-return valve 19*a*, 19*b* is shut.

In the circuit shown in FIG. 1, further limit switches 21*a*, 21*b* are provided on the directional valve 21. These switches are also electrically connected to control the pump or its prime mover (not shown). These switches also provide protection against overloading. It will be recalled that, if the pressure equilibrium between the cylinders 9 or the associated supply ducts is disturbed, the valves 19*a*, 19*b* close. If the pump continued to run, overloading due to excess pressure might arise. The switches 21*a*, 21*b* detect movement of the valve 21 caused by a disturbed hydraulic equilibrium, in particular a pressure drop in the duct 26*a* or 26*b*, and shut down the pump 10, or switch it to idle operation. This prevents pressure overloading if the valves 19*a*, 19*b* are closed owing to a leak or other disturbance of equilibrium. The switches 21*a*, 21*b* may for example respond to movement of the valve spool of the hydraulically centered valve 21.

The switches 21*a*, 21*b* can be operative optionally either independently or simultaneously with the switches 19*c*, 19*d*.

Analogous switching means may be provided on the valve 27 of the FIG. 2 circuit, or associated with the transducer 28, for controlling the pump.

We claim:

1. In a hydraulic system comprising at least one working cylinder for applying to a load a working force in a first direction, at least one further cylinder arranged to apply to said load a retraction force in a direction opposite to the first direction, and respective hydraulic pressure fluid supply conduits communicating with said at least one working cylinder and with said at least one further cylinder for selectively operating said cylinders for applying to the load the said working force or the said retraction force, the improvement in a safety system comprising:

a pressure relief valve having a fluid flow inlet communicating with the hydraulic fluid supply side of said at least one working cylinder, and a control pressure inlet communicating with a source of control pressure which opens said valve against a predetermined pressure setting to permit pressure-relieving fluid flow therethrough in response to a control pressure exceeding said predetermined pressure setting of said relief valve;

non-return valve means having a first inlet operably connected to said further-cylinder by a first conduit means, a second inlet operably connected by a second conduit means to the fluid supply conduit of the working cylinder, and an outlet connected to said control pressure inlet of said relief valve, so that said relief valve opens in response to control pressure which is the greater or the respective pressures at said first and second inlets and terminates operation of the working cylinder when the pressure in said further cylinder, applied through said first conduit means and said first inlet and said outlet, exceeds said predetermined pressure setting.

2. The hydraulic system of claim 1 wherein said non-return valve means comprises a non-reeturn shuttle valve.

3. The hydraulic system as claimed in either claim 1 or claim 2 wherein said system further comprises a plurality of said further cylinders, and a respective further non-return valve for each further cylinder operably connected in said first conduit means to provide fluid communication from the associated further fluid cylinder to said non-return valve while preventing fluid communication between said further cylinders through said first conduit means.

4. In a hydraulic system comprising at least one working cylinder for applying to a load a working force in a first direction, at least one further cylinder having a discharge orifice arranged to apply to said load a retraction force in a direction opposite the first direction, and a source of hydraulic pressure fluid for alternately actuating said cylinders, the improvement comprising:

control valve means operably connected to each further cylinder directly of the discharge orifice thereof for controlling the discharge of said pressure fluid from each further cylinder during actuation of said working cylinder, and sensing means responsive to the position of each control valve means and operably connected to said source of hydraulic pressure fluid to prevent supply of pressure fluid from said source to said working cylinder when said control valve means is closed whereby preventing actuation of said working cylinder when said fluid discharge from said further cylinder through said control valve means is prevented.

5. The system of claim 4 wherein each control valve means comprises a respective controlled non-return valve operably connected between said source of pressure fluid and said respective further cylinder, and said sensing means comprises a switch operable associated with and responsive to opening of each controlled non-return valve for controlling the supply of hydraulic pressure fluid to the working cylinder.

6. In a hydraulic system comprising a least one working cylinder for applying to a load a working force in a first direction, a plurality of further cylinders arranged to operate simultaneously for applying to the said load a retraction force in a direcction opposite the first direction, and a source of hydraulic pressure fluid for selectively actuating the working cylinder and the further cylinders, the improvement in a safety system comprising:

a directional control valve operably connected with said further cylinders so that it is in controlling relationship with the said further cylinders and is responsive to a disturbance of hydraulic fluid pressure equilibrium between said further cylinders;

sensing means responsive to the position of said directional control valve and operably connected to said source of hydraulic fluid to prevent supply of pressure fluid from said source to said further cylinders in response to said disturbance of hydraulic fluid pressure equilibrium; and respective controlled non-return valves connected between said source and said further cylinders to facilitate discharge therethrough of said pressure fluid from said further cylinders when said working cylinder is actuated, said directional control valve responsive to said disturbance of equilibrium being operably connected to said non-return valves to effect closing of said controlled non-return valves in response to said disturbance.

7. In a hydraulic system comprising at least one working cylinder for applying to a load a working force in a first direction, a plurality of retraction systems arranged in parallel to operate simultaneously for applying to the said load a retraction force in a direction opposite the first direction, each retraction system comprising a retraction cylinder, and a source of hydraulic pressure fluid for alternately actuating the working cylinder and the retraction cylinders, the improvement in a safety system comprising:

a directional control valve operably connected with said retraction systems so that it is in controlling relationship with the said retraction cylinders and further is responsive to a disturbance of hydraulic fluid pressure equilibrium between said retraction systems for terminating operation of said retraction cylinders in response to a said disturbance, and sensing means responsive to the position of said directional control valve and operably connected to said source of hydraulic fluid to prevent supply of pressure fluid from said source to said retraction systems in response to said disturbance of hydraulic fluid pressure equilibrium.

8. The system of claim 6 and further comprising for each said controlled non-return valve a respective further switch responsive to the position of the associated non-return valve and operably connected with said source so that said further switches prevent supply of pressure fluid from said source to said working cylinder when said controlled non-return valves are closed thereby preventing actuation of said working cylinder when said fluid discharge from said further cylinders through said controlled non-return valves is prevented.

9. The system of any one of claims 6 or 8, and further comprising:

a pressure relief valve having a fluid flow inlet communicating with the hydraulic fluid supply side of said at least one working cylinder, and a control pressure inlet communicating with a source of control pressure which opens said valve against a predetermined pressure setting to permit pressure-relieving fluid flow therethrough in response to a control pressure exceeding said predetermined pressure setting of said relief valve; and non-return valve means having a first inlet operably connected to said further cylinder by a first conduit means, a second inlet operably connected by a second conduit means to the fluid supply conduit of the working cylinder, and an outlet connected to said control pressure inlet of said relief valve, so that said relief valve opens in response to control pressure which is the greater of the respective pressures at said first and second inlets and terminates operation of the working cylinder where the pressure in said further cylinder, applied through said first conduit means and said first inlet and said outlet, exceeds said predetermined pressure setting 10. In a hydraulic system comprising at least one working cylinder for applying to a load a working force in a first direction, at least one further cylinder arranged to apply to said load a retraction force in a direction opposite the first direction, and a source of hydraulic pressure fluid for selectively actuating said cylinders, the improvement comprising:

control valve means operably connected to each further cylinder for controlling the discharge of said pressure fluid from each further cylinder during actuation of said working cylinder;

a pressure relief valve having a fluid flow inlet communicating with the hydraulic fluid supply side of said at least one working cylinder, and a control pressure inlet communicating with a source of control pressure which opens said valve against a predetermined pressure setting to permit pressure-relieving fluid flow therethrough in response to a control pressure exceeding said predetermined pressure setting of said relief valve;

sensing means responsive to the position of each control valve means and operably connected to said source of hydraulic pressure fluid to prevent supply of pressure fluid from said source to said working cylinder when said control valve means is closed thereby preventing actuation of said working cylinder when said further discharge from said further cylinder through said control valve means is prevented; and non-return valve means having a first inlet operably connected to said further cylinder by a first conduit means, a second inlet operably connected by a second conduit means to the fluid supply conduit of the working cylinder, and an outlet connected to said control pressure inlet of said relief valve, so that said relief valve opens in response to control pressure which is the greater of the respective pressures at said first and second inlets and terminates operation of the working cylinder where the pressure in said further cylinder, applied through said first conduit means and said first inlet and said outlet, exceeds said predetermined pressure setting.

11. The system of claim 10 wherein each control valve means comprises a respective controlled non-return valve operably connected between said source of pressure fluid and said respective further cylinder, and said sensing means comprises a switch operably associated with and responsive to opening of each controlled non-return valve for controlling the supply of hydraulic pressure fluid to the working cylinder.

12. In a hydraulic system comprising at least one working cylinder for applying to a load a working force in a first direction, a plurality of further cylinders arranged to operate simultaneously for applying to the said load a retraction force in a direction opposite the first direction, and a source of hydraulic pressure fluid for selectively actuating the working cylinder and the further cylinders, the improvement in a safety system comprising:

a directional control valve operably connected with and further cylinders so that it is in controlling relationship with the said further cylinders and is responsive to a disturbance of hydraulic fluid pressure equilibrium between said further cylinders;

sensing means responsive to the position of said directional control valve and operably connected to said source of hydraulic fluid to prevent supply of pressure fluid from said source to said further cylinders in response to said disturbance of hydraulic fluid pressure equilibrium;

a passage relief valve having a fluid flow inlet communicating with the hydraulic fluid supply side of said at least one working cylinder, and a control pressure inlet communicating with a source of control pressure which opens said valve against a predetermined pressure setting to permit pressure-relieving fluid flow therethrough in response to a control pressure exceeding said predetermined pressure setting of said relief valve; and non-return valve means having a first inlet operably connected to said further cylinder by a first conduit means, a second inlet operably connected by a second conduit means to the fluid supply conduit of the working cylinder, and an outlet connected to said control pressure inlet of said relief valve;

so that said relief valve opens in response to control pressure which is the greater of the respective pressures at said first and second inlets and terminates operation of the working cylinder where the pressure in said further cylinder, applied through said first conduit means and said first inlet and said outlet, exceeds said predetermined pressure setting.

* * * * *